US010107156B2

(12) United States Patent
Church

(10) Patent No.: US 10,107,156 B2
(45) Date of Patent: Oct. 23, 2018

(54) SINGLE LOBE DEACTIVATING ROCKER ARM

(71) Applicant: Eaton Corporation, Cleveland, OH (US)

(72) Inventor: Kynan L. Church, Corbett, OR (US)

(73) Assignee: Eaton Corporation, Cleveland, OH (US)

( * ) Notice: Subject to any disclaimer, the term of this patent is extended or adjusted under 35 U.S.C. 154(b) by 419 days.

(21) Appl. No.: 14/848,471

(22) Filed: Sep. 9, 2015

(65) Prior Publication Data

US 2015/0377093 A1 Dec. 31, 2015

Related U.S. Application Data

(63) Continuation of application No. 14/154,319, filed on Jan. 14, 2014, now Pat. No. 9,140,148, which is a (Continued)

(51) Int. Cl.
*F01L 13/00* (2006.01)
*F01L 1/18* (2006.01)

(52) U.S. Cl.
CPC ..... *F01L 13/0005* (2013.01); *F01L 1/18* (2013.01); *F01L 1/185* (2013.01); (Continued)

(58) Field of Classification Search
CPC ... F01L 13/0036; F01L 1/185; F01L 13/0005; F01L 2105/00; F01L 2001/186; (Continued)

(56) References Cited

U.S. PATENT DOCUMENTS 4,151,817 A 5/1979 Mueller
4,203,397 A 5/1980 Soeters
(Continued)

FOREIGN PATENT DOCUMENTS

DE 102006046573 A 4/2008
DE 102006061296 A 6/2008
(Continued)

OTHER PUBLICATIONS

European Search Report for European Application No. 11177481/6 dated Dec. 21, 2011.

*Primary Examiner* — Mark Laurenzi
*Assistant Examiner* — Wesley Harris
(74) *Attorney, Agent, or Firm* — RMCK Law Group PLC

(57) ABSTRACT

A deactivating rocker arm can include an outer arm extending between a first end and a second end. The outer arm can have a first outer side arm and a second outer side arm. The first and second outer side arms can define outer pivot axle apertures and axle slots. The inner arm can be disposed between the first and second outer side arms. The inner arm can have a first inner side arm and a second inner side arm. The first and second inner side arms can define bearing apertures. A bearing can be mounted in the bearing apertures of the inner arm and the axle slots of the outer arm. The axle slots can be configured to permit lost motion movement of the bearing. A first biasing member can be disposed on the second end of the outer arm and in biasing contact with the bearing.

18 Claims, 3 Drawing Sheets

Related U.S. Application Data continuation of application No. 13/532,777, filed on Jun. 25, 2012, now Pat. No. 8,635,980, which is a continuation of application No. 12/856,266, filed on Aug. 13, 2010, now Pat. No. 8,215,275.

(52) U.S. Cl.
CPC ..... *F01L 13/0015* (2013.01); *F01L 13/0036* (2013.01); *F01L 2001/186* (2013.01); *F01L 2105/00* (2013.01); *Y10T 74/20882* (2015.01); *Y10T 74/2107* (2015.01)

(58) Field of Classification Search
CPC ... F01L 1/18; F01L 13/0015; Y10T 74/20882; Y10T 74/2107
See application file for complete search history.

(56) References Cited

U.S. PATENT DOCUMENTS

| | | | | |
|---|---|---|---|---|
| 4,762,096 | A | 8/1988 | Kamm et al. | |
| 4,768,467 | A | 9/1988 | Yamada et al. | |
| 5,419,290 | A | 5/1995 | Hurr et al. | |
| 5,445,116 | A | 8/1995 | Hara | |
| 5,529,033 | A | 6/1996 | Hampton | |
| 6,325,030 | B1 | 12/2001 | Spath et al. | |
| 6,532,920 | B1 | 3/2003 | Sweetnam et al. | |
| 6,997,152 | B2 | 2/2006 | Harris | |
| 7,546,822 | B2 | 6/2009 | Murphy et al. | |
| 7,730,861 | B2 | 6/2010 | Ng | |
| 8,215,275 | B2 | 7/2012 | Church | |
| 8,627,796 | B2 * | 1/2014 | Harman | F01L 1/185 123/90.16 |
| 8,635,980 | B2 | 1/2014 | Church | |
| 9,115,607 | B2 * | 8/2015 | Harman | F01L 1/185 |
| 2001/0023672 | A1 * | 9/2001 | Cecur | F01L 1/185 123/90.16 |
| 2003/0230270 | A1 | 12/2003 | Seitz | |
| 2004/0074459 | A1 | 4/2004 | Hayman et al. | |
| 2008/0245330 | A1 | 10/2008 | Deierlein et al. | |
| 2009/0000584 | A1 * | 1/2009 | Rorig | F01L 1/185 123/90.39 |
| 2015/0285110 | A1 * | 10/2015 | Sugiura | F01L 13/0021 123/90.16 |
| 2017/0350282 | A1 * | 12/2017 | Suzuki | F01L 1/24 |

FOREIGN PATENT DOCUMENTS

| | | | |
|---|---|---|---|
| WO | 03042511 | A | 5/2003 |
| WO | 2004053303 | A | 6/2004 |

* cited by examiner

SINGLE LOBE DEACTIVATING ROCKER ARM

CROSS REFERENCE TO RELATED APPLICATION

This application is a continuation of U.S. Continuation patent application Ser. No. 14/154,319 filed Jan. 14, 2014 now U.S. Pat. No. 9,140,148 which is a continuation of U.S. Continuation patent application Ser. No. 13/532,777 filed Jun. 25, 2012 now U.S. Pat. No. 8,635,980 which is a continuation of U.S. Non-Provisional patent application Ser. No. 12/856,266 filed on Aug. 13, 2010 now U.S. Pat. No. 8,215,275. The disclosures of these applications are hereby incorporated by reference in their entirety.

FIELD

This application is directed to deactivating rocker arms for internal combustion engines.

BACKGROUND

Many internal combustion engines utilize rocker arms to transfer rotational motion of cams to linear motion appropriate for opening and closing engine valves. Deactivating rocker arms incorporate mechanisms that allow for selective activation and deactivation of the rocker arm. In a deactivated state, the rocker arm may exhibit lost motion movement. In order to return to an activated state from a deactivated state, the mechanism may require that the rocker arm be in a particular position or within a range of positions that may not be readily achieved while undergoing certain unconstrained movement while in the deactivated state, such as during excessive lash adjuster pump-up.

SUMMARY

A deactivating rocker arm for engaging a cam having a lift lobe and at least one safety lobe is provided. The deactivating rocker arm can include an outer arm having a first outer side arm and a second outer side arm. The first and second outer side arms can define (i) outer pivot axle apertures, (ii) axle slots, and (iii) safety lobe contacting surfaces that are spaced from a first and a second safety lobe on the cam during normal rocker arm operation. An inner arm can be disposed between the first and second outer side arms. The inner arm can have a first inner side arm and a second inner side arm. The first and second inner side arms can define inner pivot axle apertures and inner bearing axle apertures. A pivot axle can be disposed in the inner pivot axle apertures and the outer pivot axle apertures. A bearing can be mounted in the inner bearing axle apertures of the inner arm and the axle slots of the outer arm. A latch can be configured to selectively deactivate the rocker arm. A first biasing member can be disposed on the outer am and in biasing contact with the bearing.

According to additional features the axle slots are configured to permit lost motion movement of the bearing. The bearing can be mounted on a bearing axle. The deactivating rocker arm extends between a first end and a second end. The pivot axle is mounted adjacent to the first end. The latch is mounted adjacent to the second end. The first biasing member is disposed at the second end. The outer arm includes a mount that secures the first biasing member. A second biasing member is disposed at the second end. The first biasing member is secured to the first outer side arm. The second biasing member is secured to the second outer side arm.

A deactivating rocker arm for engaging a cam having a lift lobe and at least one safety lobe constructed in accordance to additional features includes an outer arm, an inner arm, a pivot axle, a bearing and at least one spring. The outer arm has a first and second outer side arm. The first and second outer side arms have at least one safety lobe contacting surface and outer pivot axle apertures. The inner arm is disposed between the first and second outer side arms and has a first and second inner side arm. The first and second inner side arms have inner bearing axle apertures and inner pivot axle apertures. The pivot axle is disposed in the outer pivot axle apertures and the inner pivot axle apertures. The bearing is rotatably positioned within the inner arm. The at least one spring is secured to the outer arm and is in biasing contact with the bearing.

According to other features, the deactivating rocker arm further includes inner bearing axle apertures on the first and second inner side arms configured for mounting a bearing axle that rotatably supports the bearing. The pivot axle is disposed in the inner pivot axle apertures and the outer pivot axle apertures such that the inner arm pivots relative to the outer arm and the pivot axle during lost motion movement. The bearing can be mounted to the bearing axle between the first and second inner side arm. The deactivating rocker arm can further include a latch for selectively securing the inner arm relative to the outer arm thereby selectively permitting lost motion movement of the inner arm relative to the outer arm about the pivot axle. The deactivating rocker arm can extend between a first end and a second end. The pivot axle is mounted adjacent to the first end and the latch is mounted adjacent to the second end. The at least one spring includes a first and a second bearing axle spring. The first bearing axle spring can be secured to the first outer side arm and the second bearing axle spring can be secured to the second outer side arm. The first and second bearing axle spring can be in biasing contact with the bearing axle.

A deactivating rocker arm for engaging a cam having a lift lobe and at least one safety lobe constructed in accordance to additional features includes an outer arm, an inner arm, a pivot axle, a bearing and a first biasing member. The outer arm can extend between a first end and a second end. The outer arm can have a first outer side arm and a second outer side arm. The first and second outer side arms can define outer pivot axle apertures and axle slots. The inner arm can be disposed between the first and second outer side arms. The inner arm can have a first inner side arm and a second inner side arm. The first and second inner side arms can define bearing apertures and inner pivot axle apertures. The pivot axle can be disposed on the first end of the outer arm in the outer pivot axle apertures and extend into the inner pivot axle apertures of the inner arm. The bearing can be mounted on a bearing axle mounted in the bearing apertures of the inner arm and the axle slots of the outer arm. The axle slots can be configured to permit lost motion movement of the bearing axle. The first biasing member can be disposed on the outer arm and in biasing contact with the bearing.

According to additional features, the deactivating rocker arm can include a latch configured to selectively deactivate the rocker arm. The bearing axle includes a knob extending from an end of the bearing axle that creates a slot that receives an end of the first bearing member. The outer arm can include a mount that secures the first biasing member. The deactivating rocker arm can further comprise a second biasing member. The first biasing member can be secured to the first outer side arm. The second biasing member can be secured to the second outer side arm. The first and second outer side arms can include safety lobe contacting surfaces configured to be spaced from a first and a second safety lobe on the cam during normal rocker arm operation.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1:
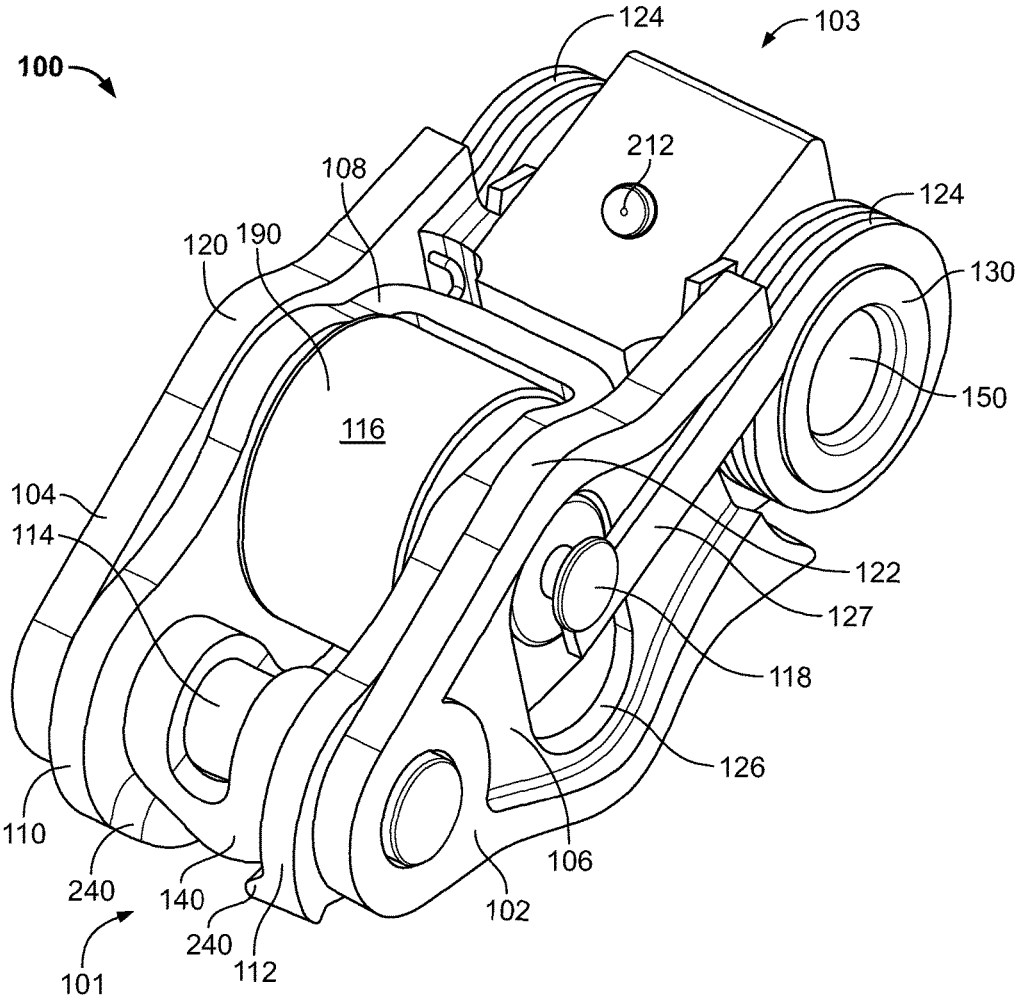
FIG. 1 illustrates a perspective view of an exemplary rocker arm 100 incorporating first and second safety lobe contacting surfaces 120, 122.

Certain terminology will be used in the following description for convenience in describing the figures will not be limiting. The terms "upward," "downward," and other directional terms used herein will be understood to have their normal meanings and will refer to those directions as the drawing figures are normally viewed.

FIG. 1 illustrates a perspective view of an exemplary deactivating rocker arm 100. The deactivating rocker arm 100 is shown by way of example only and it will be appreciated that the configuration of the deactivating rocker arm 100 that is the subject of this application is not limited to the configuration of the deactivating rocker arm 100 illustrated in the figures contained herein.

Figure 2:
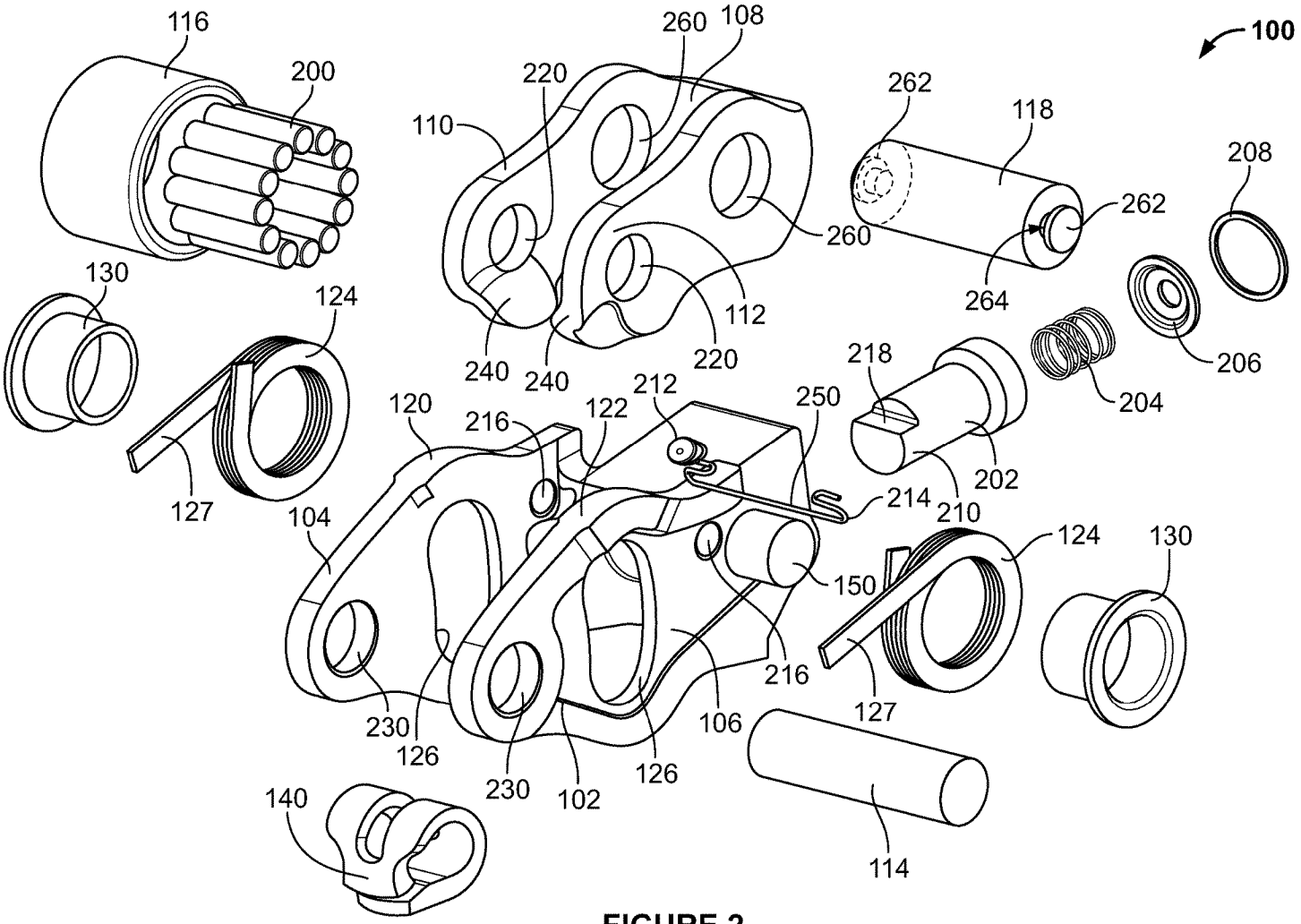
FIG. 2 illustrates an exploded view of the exemplary rocker arm 100 incorporating first and second safety lobe contacting surfaces 120, 122 shown in FIG. 1.

As shown in FIGS. 1 and 2, the deactivating rocker arm 100 includes an outer arm 102 having a first outer side arm 104 and a second outer side arm 106. An inner arm 108 is disposed between the first outer side arm 104 and second outer side arm 106. The inner arm 108 has a first inner side arm 110 and a second inner side arm 112. The inner arm 108 and outer arm 102 are both mounted to a pivot axle 114, located adjacent the first end 101 of the rocker arm 100, which secures the inner arm 108 to the outer arm 102 while also allowing a rotational degree of freedom pivoting about the pivot axle 114 when the deactivating rocker arm 100 is in a deactivated state. In addition to the illustrated example having a separate pivot axle 114 mounted to the outer arm 102 and inner arm 108, the pivot axle 114 may be integral to the outer arm 102 or the inner arm 108.

The rocker arm 100 has a bearing 190 comprising a roller 116 that is mounted between the first inner side arm 110 and second inner side arm 112 on a bearing axle 118 that, during normal operation of the rocker arm, serves to transfer energy from a rotating cam (not shown) to the rocker arm 100. Mounting the roller 116 on the bearing axle 118 allows the bearing 190 to rotate about the axle 118, which serves to reduce the friction generated by the contact of the rotating cam with the roller 116. As discussed herein, the roller 116 is rotatably secured to the inner arm 108, which in turn may rotate relative to the outer arm 102 about the pivot axle 114 under certain conditions. In the illustrated example, the bearing axle 118 is mounted to the inner arm 108 in the bearing axle apertures 260 of the inner arm 108 and extends through the bearing axle slots 126 of the outer arm 102. Other configurations are possible when utilizing a bearing axle 118, such as having the bearing axle 118 not extend through bearing axle slots 126 but still mounted in bearing axle apertures 260 of the inner arm 108, for example.

When the rocker arm 100 is in a deactivated state, the inner arm 108 pivots downwardly relative to the outer arm 102 when the lifting portion of the cam (324 in FIG. 3) comes into contact with the roller 116 of bearing 190, thereby pressing it downward. The axle slots 126 allow for the downward movement of the bearing axle 118, and therefore of the inner arm 108 and bearing 190. As the cam continues to rotate, the lifting portion of the cam rotates away from the roller 116 of bearing 190, allowing the bearing 190 to move upwardly as the bearing axle 118 is biased upwardly by the bearing axle springs 124. The illustrated bearing axle springs 124 are torsion springs secured to mounts 150 located on the outer arm 102 by spring retainers 130. The bearing axle springs 124 are secured adjacent the second end 103 of the rocker arm 100 and have spring arms 127 that come into contact with the bearing axle 118. As the bearing axle 118 and spring arm 127 move downward, the bearing axle 118 slides along the spring arm 127. The configuration of rocker arm 100 having the axle springs 124 secured adjacent the second end 103 of the rocker arm 100, and the pivot axle 114 located adjacent the first end 101 of the rocker arm, with the bearing axle 118 between the pivot axle 114 and the axle spring 124, lessens the mass near the first end 101 of the rocker arm.

Figure 3:
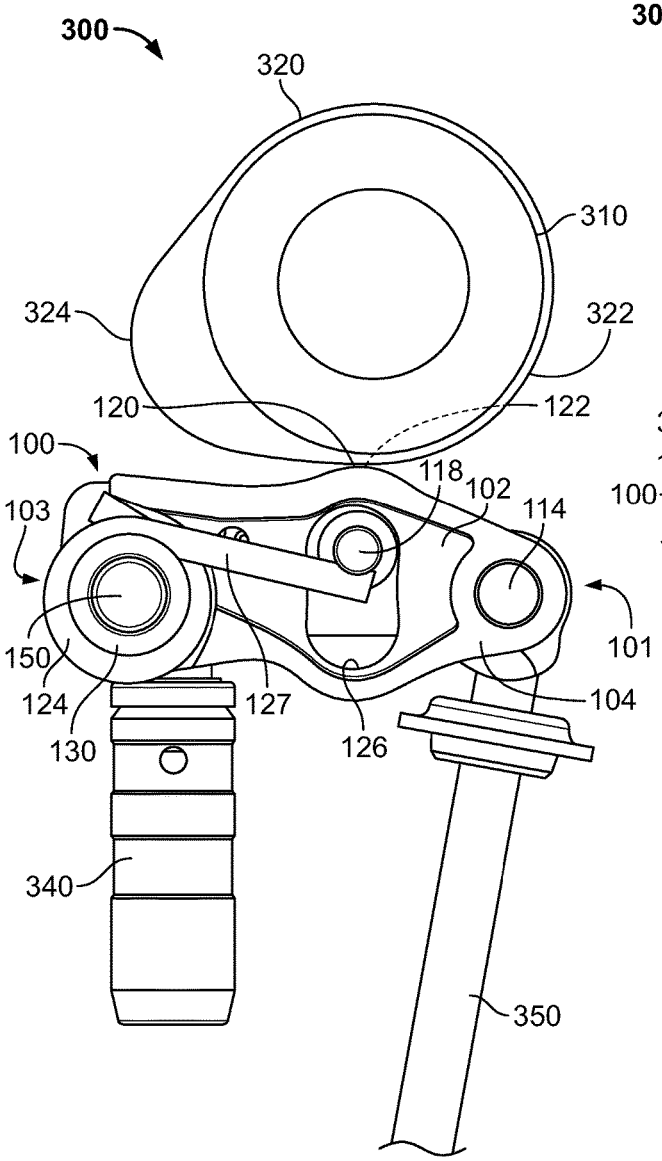
FIG. 3 illustrates a side view of the deactivating rocker arm 100 in relation to a cam 300, lash adjuster 340 and valve stem 350.
Figure 4:
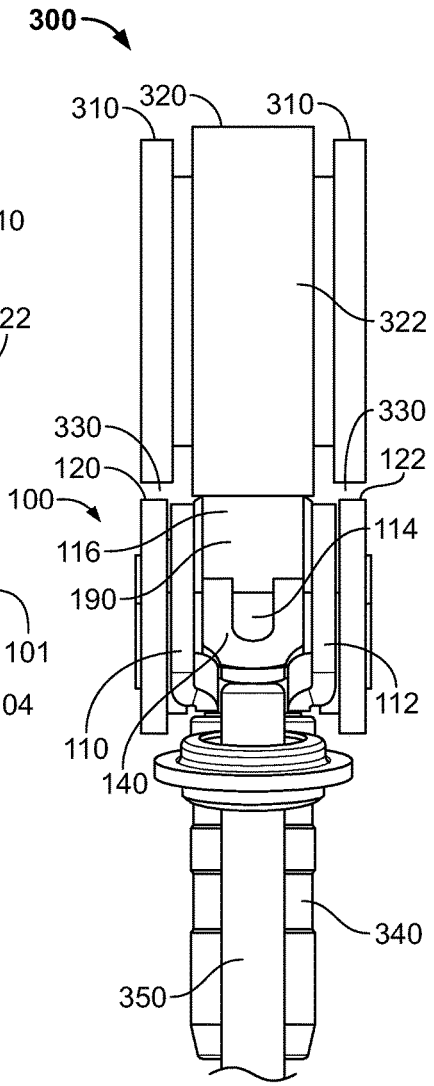
FIG. 4 illustrates a front view of the deactivating rocker arm 100 in relation to a cam 300, lash adjuster 340 and valve stem 350.

As shown in FIGS. 3 and 4, the valve stem 350 is also in contact with the rocker arm 100 near its first end 101, and thus the reduced mass at the first end 101 of the rocker arm 100 reduces the mass of the overall valve train (not shown), thereby reducing the force necessary to change the velocity of the valve train. It should be noted that other spring configurations may be used to bias the bearing axle 118, such as a single continuous spring.

With continued reference to FIG. 1, the first outer side arm 104 and second outer side arm 106 have a first safety lobe contacting surface 120 and second safety lobe contacting surface 122, respectively, positioned at the top of the outer arm 102. As shown in more detail in FIGS. 3 and 4, during normal operation, the surfaces 120, 122 are spaced from the safety lobes 310 of the cam. The surfaces 120, 122 are configured to come into contact with the safety lobes 310 only when the rocker arm 100 is functioning abnormally, such as a failure of the rocker arm 100. In certain abnormal conditions, examples of which are described more fully below, the surfaces 120, 122 come into contact with the safety lobes 310, thereby preventing the rocker arm 100 from moving upwardly by an undesirable amount. By limiting the contact between the safety lobe contacting surfaces 120, 122 and the safety lobes to instances where the rocker arm 100 is operating abnormally, rather than having frequent or constant contact, the need for placement of friction pads or preparing the safety lobe contacting surfaces 120, 122 with a durable wear surface is eliminated, thereby achieving cost efficiencies.

FIG. 2 illustrates an exploded view of the deactivating rocker arm 100 of FIG. 1. As shown in FIG. 2, when assembled, the bearing 190 shown in FIG. 1 is a needle roller-type bearing that comprises a substantially cylindrical roller 116 in combination with needles 200, which can be mounted on a bearing axle 118. The bearing 190 serves to transfer the rotational motion of the cam to the rocker arm 100 that in turn transfers motion to the valve stem 350, for example in the configuration shown in FIGS. 3 and 4. As shown in FIGS. 1 and 2, the bearing axle 118 may be mounted in the bearing axle apertures 260 of the inner arm 108. In such a configuration, the axle slots 126 of the outer arm 102 accept the bearing axle 118 and allow for lost motion movement of the bearing axle 118 and by extension the inner arm 108 when the rocker arm 100 is in a deactivated state. "Lost motion" movement can be considered movement of the rocker arm 100 that does not transmit the rotating motion of the cam to the valve. In the illustrated examples, lost motion is exhibited by the pivotal motion of the inner arm 108 relative to the outer arm 102 about the pivot axle 114. Knob 262 extends from the end of the bearing axle 118 and creates a slot 264 in which the spring arm 127 sits. In one alternative, a hollow bearing axle 118 may be used along with a separate spring mounting pin (not shown) comprising a feature such as the knob 262 and slot 264 for mounting the spring arm 127 in a manner similar to that shown in FIG. 2.

Other configurations other than bearing 190 also permit the transfer of motion from the cam to the rocker arm 100. For example, a smooth non-rotating surface (not shown) for interfacing with the cam lift lobe (320 in FIG. 3) may be mounted on or formed integral to the inner arm 108 at approximately the location where the bearing 190 is shown in FIG. 1 relative to the inner arm 108 and rocker arm 100. Such a non-rotating surface may comprise a friction pad formed on the non-rotating surface. In another example, alternative bearings, such as bearings with multiple concentric rollers, may be used effectively as a substitute for bearing 190.

The mechanism for selectively deactivating the rocker arm 100, which in the illustrated example is found near the second end 103 of the rocker arm 100, is shown in FIG. 2 as comprising latch 202, latch spring 204, spring retainer 206 and clip 208. The latch 202 is configured to be mounted inside the outer arm 102. The latch spring 204 is placed inside the latch 202 and secured in place by the latch spring retainer 206 and clip 208. Once installed, the latch spring 204 biases the latch 202 toward the first end 101 of the rocker arm 100, allowing the latch 202, and in particular the engaging portion 210 to engage the inner arm 108, thereby preventing the inner arm 108 from moving with respect to the outer arm 102. When the latch 202 is engaged with the inner arm in this way, the rocker arm 100 is in the activated state, and will transfer motion from the cam to the valve stem.

In the assembled rocker arm 100, the latch 202 alternates between activating and deactivating positions. To deactivate the rocker arm 100, oil pressure sufficient to counteract the biasing force of latch spring 204 may be applied, for example, through the port 212 which is configured to permit oil pressure to be applied to the surface of the latch 202. When the oil pressure is applied, the latch 202 is pushed toward the second end 103 of the rocker arm 100, thereby withdrawing the latch 202 from engagement with the inner arm 108 and allowing the inner arm 108 to rotate about the pivot axle 114. In both the activated and deactivated states, the linear portion 250 of orientation clip 214 engages the latch 202 at the flat surface 218. The orientation clip is mounted in the clip apertures 216, and thereby maintains a horizontal orientation of the linear portion 250 relative to the rocker arm 100. This restricts the orientation of the flat surface 218 to also be horizontal, thereby orienting the latch 202 in the appropriate direction for consistent engagement with the inner arm 108.

With reference to FIGS. 1 and 2, the elephant foot 140 is mounted on the pivot axle 114 between the first 110 and second 112 inner side arms. The pivot axle 114 is mounted in the inner pivot axle apertures 220 and outer pivot axle apertures 230 adjacent the first end 101 of the rocker arm 100. Lips 240 formed on inner arm 108 prevent the elephant foot 140 from rotating about the pivot axle 114. The elephant foot 140 engages the end of the valve stem 350 as shown in FIG. 4. In an alternative example, the elephant foot 140 may be removed, and instead an interfacing surface complementary to the tip of the valve stem 350 may be placed on the pivot axle 114.

FIGS. 3 and 4 illustrate a side view and front view, respectively, of rocker arm 100 in relation to a cam 300 having a lift lobe 320 with a base circle 322 and lifting portion 324, and two circular safety lobes 310 positioned above the first and second safety lobe contacting surfaces 120, 122. The circular safety lobes 310 are concentric with the base circle 322 of the lift lobe 320, and have a smaller diameter than the diameter of the base circle 322. It should be noted that the diameter of the two safety lobes 310 need not be identical, need not be circular, and may have a diameter equal to or larger than the diameter of the base circle 322. In such a scenario, the first and second safety lobe contacting surfaces 120, 122 should be appropriately located such that they are spaced from the safety lobes 310 under normal engine operation, but also come into contact with the safety lobes 310 under abnormal engine conditions, for example under the abnormal conditions as described herein. As is clear from FIGS. 3 and 4, first and second safety lobe contacting surfaces 120, 122, when used in combination with the circular safety lobes 310, do not transfer rotational motion of the cam to the rocker arm. In other examples, a rocker arm 100 having one or three or more safety lobe contacting surfaces may be used, for example, with cams having one safety lobe, or three or more safety lobes (not shown).

FIGS. 3 and 4 illustrate the roller 116 in contact with the lift lobe 320. A lash adjuster 340 engages the rocker arm 100 adjacent its second end 103, and applies upward pressure to the rocker arm 100, and in particular the outer rocker arm 102, while mitigating against valve lash. The valve stem 350 engages the elephant foot 140 adjacent the first end 101 of the rocker arm 100. In the activated state, the rocker arm 100 periodically pushes the valve stem 350 downward, which serves to open the corresponding valve (not shown).

During normal operation, which may occur when the rocker arm 100 is in an activated or deactivated state, a gap 330 separates the safety lobes 310 from the first and second safety lobe contacting surfaces 120, 122. However, during certain abnormal operation, the safety lobes 310 may come into contact with the first and second safety lobe contacting surfaces 120, 122. In one such scenario, a deactivated rocker arm 100 is subjected to excessive pump-up of the lash adjuster 340, whether due to excessive oil pressure, the onset of non-steady-state conditions, for example as a result of dynamic mis-motion that may be caused by high revolutions per second, or other causes. This results in an increase in the effective length of the lash adjuster 340 as pressurized oil fills its interior. Such a scenario may occur for example during a cold start of the engine, and could take significant time to resolve on its own if left unchecked and could even result in permanent engine damage. Under such circumstances, the latch 202 may not be able to activate the rocker arm 100 until the lash adjuster 340 has returned to a normal operating length. In this scenario, the lash adjuster 340 applies upward pressure to the outer arm 102, bringing the outer arm 102 closer to the cam 300. As the outer arm 102 continues upward, the safety lobe contacting surfaces 120, 122 come into contact with the safety lobes 310, preventing further upward movement of the outer arm 102, which, if unimpeded, could result in a portion of the rocker arm 100 near the rocker arm second end 103 undesirably contacting the cam 300. This illustrated example allows for relatively quicker return to normal operating conditions for the rocker arm 100, and in addition may allow for the rocker arm 100 to return to an activated state more quickly, thus avoiding an excessively long recovery time waiting for the rocker arm 100 to return to an activated state.

Still other scenarios may result in the safety lobe contacting surfaces 120, 122 coming into contact with the safety lobes 310. For example, a failure of the roller 116 or the bearing axle 118, or a failure of the lift lobe 320 may result in the safety lobe contacting surfaces 120, 122 coming into contact with the safety lobes 310. It should be noted that not all abnormal operating circumstances for the rocker arm will result in the safety lobes 310 coming into contact with the first and second safety lobe contacting surfaces 120, 122.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present disclosure illustrates various examples, and while these examples have been described in some detail, it is not the intention of the applicant to restrict or in any way limit the scope of the claimed disclosure to such detail. Additional advantages and modifications will readily appear to those skilled in the art. Therefore, the disclosure, in its broader aspects, is not limited to the specific details and illustrative examples shown and described. Accordingly, departures may be made from such details without departing from the spirit or scope of the applicant's claimed disclosure. Moreover, the foregoing examples are illustrative, and no single feature or element is essential to all possible combinations that may be claimed in this or a later application.

The invention claimed is:

1. A deactivating rocker arm for engaging a cam having a lift lobe and at least one safety lobe, the deactivating rocker arm comprising:

an outer arm having a first outer side arm and a second outer side arm, the first and second outer side arms defining (i) outer pivot axle apertures, (ii) axle slots, and (iii) safety lobe contacting surfaces that are spaced from a first and a second safety lobe on the cam during normal rocker arm operation;

an inner arm disposed between the first and second outer side arms, the inner arm having a first inner side arm and a second inner side arm, the first and second inner side arms defining inner pivot axle apertures and inner bearing axle apertures;

a bearing axle supported by the inner bearing axle apertures, the bearing axle defining a first slot;

a pivot axle disposed in the inner pivot axle apertures and the outer pivot axle apertures;

a bearing mounted on the bearing axle;

a latch configured to selectively deactivate the rocker arm; and a first biasing member disposed on the outer arm and in biasing contact with the bearing, the first biasing member having a first end received by the first slot.

2. The deactivating rocker arm of claim 1, wherein the axle slots are configured to permit lost motion movement of the bearing.

3. The deactivating rocker arm of claim 1 wherein the deactivating rocker arm extends between a first end and a second end, wherein the pivot axle is mounted adjacent to the first end and the latch is mounted adjacent to the second end.

4. The deactivating rocker arm of claim 3 wherein the first biasing member is disposed at the second end.

5. The deactivating rocker arm of claim 4 wherein the outer arm includes a mount that secures the first biasing member.

6. The deactivating rocker arm of claim 4, further comprising a second biasing member disposed at the second end, wherein the first biasing member is secured to the first outer side arm and the second biasing member is secured to the second outer side arm.

7. A deactivating rocker arm for engaging a cam having a lift lobe and at least one safety lobe, the deactivating rocker arm comprising:

an outer arm having a first and second outer side arm, the first and second outer side arms having at least one safety lobe contacting surface and outer pivot axle apertures;

an inner arm disposed between the first and second outer side arms and having a first and second inner side arm, the first and second inner side arms having inner bearing axle apertures and inner pivot axle apertures;

a pivot axle disposed in the outer pivot axle apertures and the inner pivot axle apertures;

a bearing rotatably supported by a bearing axle and positioned within the inner arm, the bearing axle defining a slot; and at least one spring secured to the outer arm and in biasing contact with the bearing, wherein one spring of the at least one spring has a spring end received by the slot.

8. The deactivating rocker arm of claim 7, further comprising inner bearing axle apertures on the first and second inner side arms configured for mounting a bearing axle that rotatably supports the bearing.

9. The deactivating rocker arm of claim 8, wherein the pivot axle is disposed in the inner pivot axle apertures and the outer pivot axle apertures such that the inner arm pivots relative to the outer arm about the pivot axle during lost motion movement.

10. The deactivating rocker arm of claim 9, further comprising a latch for selectively securing the inner arm relative to the outer arm thereby selectively permitting lost motion movement of the inner arm relative to the outer arm about the pivot axle.

11. The deactivating rocker arm of claim 10 wherein the deactivating rocker arm extends between a first end and a second end, wherein the pivot axle is mounted adjacent to the first end and the latch is mounted adjacent to the second end.

12. The deactivating rocker arm of claim 8 wherein the at least one spring comprises:

a first and a second bearing axle spring, the first bearing axle spring secured to the first outer side arm and the second bearing axle spring secured to the second outer side arm, the first and second bearing axle spring in biasing contact with the bearing axle.

13. The deactivating rocker arm of claim 7, wherein the bearing is mounted to the bearing axle between the first and second inner side arm.

14. A deactivating rocker arm for engaging a cam having a lift lobe, the deactivating rocker arm comprising:

an outer arm extending between a first end and a second end, the outer arm having a first outer side arm and a second outer side arm, the first and second outer side arms defining outer pivot axle apertures and axle slots;

an inner arm disposed between the first and second outer side arms, the inner arm having a first inner side arm and a second inner side arm, the first and second inner side arms defining bearing apertures and inner pivot axle apertures;

a pivot axle disposed on the first end of the outer arm in the outer pivot axle apertures and extending into the inner pivot axle apertures of the inner arm;

a bearing mounted on a bearing axle mounted in the bearing apertures of the inner arm and the axle slots of the outer arm, the axle slots configured to permit lost motion movement of the bearing axle, the bearing axle having a knob extending from an end of the bearing axle that defines a slot; and a first biasing member disposed on the outer arm and in biasing contact with the bearing, wherein an end of the first biasing member is received by the slot.

15. The deactivating rocker arm of claim 14, further comprising a latch configured to selectively deactivate the rocker arm.

16. The deactivating rocker arm of claim 14 wherein the outer arm includes a mount that secures the first biasing member.

17. The deactivating rocker arm of claim 14, further comprising a second biasing member, wherein the first biasing member is secured to the first outer side arm and the second biasing member is secured to the second outer side arm.

18. The deactivating rocker arm of claim 14 wherein the first and second outer side arms include safety lobe contacting surfaces configured to be spaced from a first and a second safety lobe on the cam during normal rocker arm operation.

* * * * *